United States Patent [19]

Baudry et al.

[11] Patent Number: 4,973,826

[45] Date of Patent: Nov. 27, 1990

[54] GLASS-CERAMIC HEATING ELEMENT

[75] Inventors: Hughes Baudry, Varennes-Jarcy; Marc Monneraye, Saint-Maur-des-Fosses; Claude Morhaim, Paris, all of France

[73] Assignee: U.S. Philips Corp., New York, N.Y.

[21] Appl. No.: 271,138

[22] Filed: Nov. 14, 1988

[30] Foreign Application Priority Data

Nov. 24, 1987 [FR] France ..... 87 16255

[51] Int. Cl.[5] ..... H05B 3/28

[52] U.S. Cl. ..... 219/464; 338/306

[58] Field of Search ..... 219/464, 345, 213; 338/306–314

[56] References Cited

U.S. PATENT DOCUMENTS 3,978,316 8/1976 Rose et al. ..... 219/543
4,323,652 4/1982 Baudry .
4,420,338 12/1983 Ortega .

FOREIGN PATENT DOCUMENTS 2011769 11/1978 United Kingdom .

*Primary Examiner*—Roy N. Envall, Jr.

*Attorney, Agent, or Firm*—Ernestine C. Bartlett

[57] ABSTRACT

Glass-ceramic heating element comprising at least a flat electric heating member which is provided on a glass-ceramic plate and can be heated to a temperature between ambient temperature and approximately 650° C. forming a heat source, wherein the electric heating member is produced by depositing screen-printed layers on the surface denoted the lower surface to distinguish it from the working surface of the glass-ceramic plate, these layers having a coefficient of expansion near that of the glass-ceramic material at elevated temperatures and being capable of being heated by thermal dissipation to temperatures of about 650° C., and wherein the heating member is formed from this lower surface by a first layer 21 of a material constituting an electric insulator at high tempertures, a second layer 22 of a conductive material to form the two current supply lines $C_1$ and $C_2$ for the input and the output of the heating member and a third layer 23 of a dielectric material to constitute a heating resistor R, arranged between the lines $C_1$ and $C_2$ in the form of a circuit of such a design that it can uniformly distribute the heat over the overall heat source surface. The heating element is suitable for use in hot plates, kitchen ranges and ovens.

20 Claims, 4 Drawing Sheets

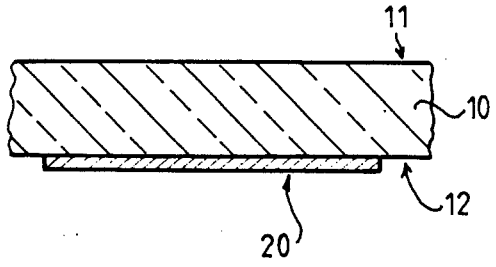
FIG.1
FIG.3
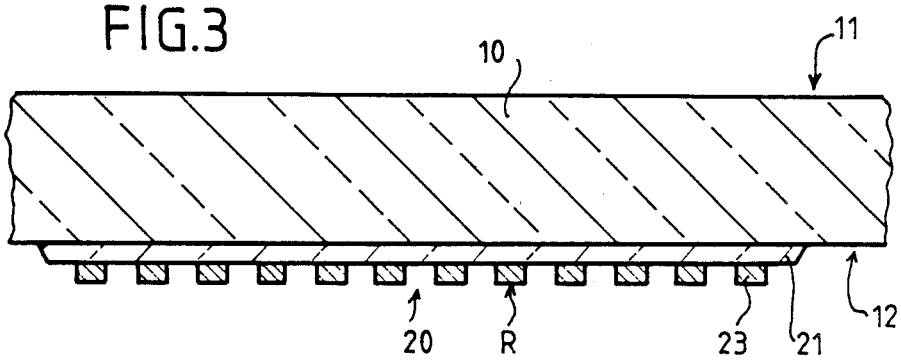
FIG.4
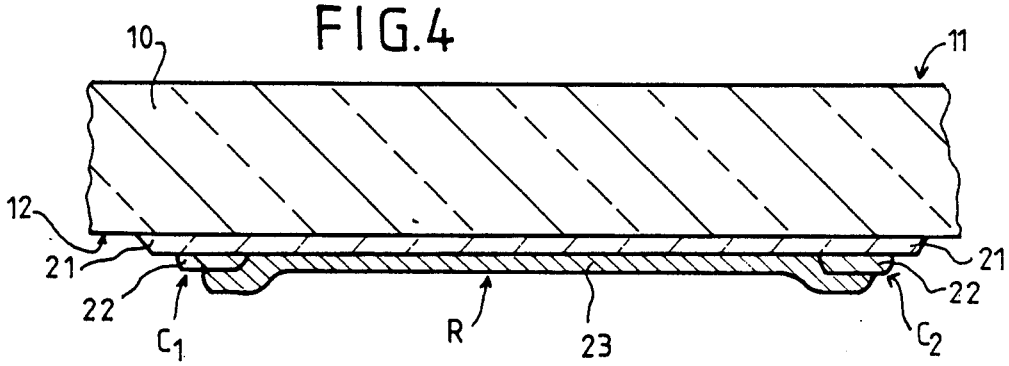

GLASS-CERAMIC HEATING ELEMENT

FIELD OF THE INVENTION

The invention relates to a glass-ceramic heating element comprising at least a flat electric heating member provided on a glass-ceramic plate.

The invention is used to provide household appliances for which a glass-ceramic plate is required which is easy to maintain, used for a heat source operating at high temperatures higher than or equal to 650° C.

BACKGROUND OF THE INVENTION

The French Patent Specification FR-2,410,790 discloses a glass-ceramic cooking unit comprising an electric heating member which is disposed as a helix under the hot plate and also a thermostatic sensor which is thermally coupled to the hot plate within the zone of the cooking surface. The outer zone of the cooking surface is provided with an unheated zone for the thermal coupling of the sensor, the remaining portion of the surface being covered by the two-wire heating member whose connections are located at the periphery of the cooking surface. However a hot plate of such a structure has several disadvantages. Firstly, the heating device is still expensive because of its complex structure. Moreover, it is located at some distance from the glass-ceramic plate, which causes thermal losses. Thus, it is subjected to a cooling and heating time constant which is mainly due to the poor thermal conduction of the air, which renders this type of hot plate less flexible in use than, for example, cookers with controllable flames.

SUMMARY OF THE INVENTION

The present invention has for its object the provision of a heating element which does not have these disadvantages.

According to the invention, these problems are solved by a heating element comprising at least a flat electric heating member provided on a glass-ceramic plate characterized in that the electric heating member is produced by depositing screen-printed layers on the surface denoted the lower surface to distinguish it from the working surface of the glass-ceramic plate, these layers having a coefficient of expansion near that of the glass-ceramic material at elevated temperatures and being capable of being heated by thermal dissipation to temperatures of the order of 650° C., and that it is formed starting from this lower surface by a first layer 21 of a material constituting an electric insulator at high temperatures, a second layer 22 of a conducting material to form the two current supply lines $C_1$ and $C_2$ for the input and the output of the heating member and a third layer 23 of a dielectric material to constitute a heating resistor R, arranged between the lines $C_1$ and $C_2$ in the form of a circuit of such a design that it can uniformly distribute the heat over the overall heat source surface.

The present invention solves several other problems in addition to the problems described in the foregoing. Actually, in the state of the art resistors are already known which are produced by screen-printing and can reach temperatures of the order of approximately 150° C. on ceramic ($Al_2O_3$) substrates. These temperatures are absolutely insufficient to provide hot plates for cooking purposes where temperatures of the order of 650° C. are necessary.

The invention solves this problem by providing a novel formulation for a high-temperature resistance paste. But it is also necessary for the coefficient of expansion of this paste to be, at the cooking temperature, or at the operating temperature, as near as possible to that of the glass-ceramic substrate, which is substantially zero. This is difficult to realize for a resistance material containing conducting particles. The invention however solves this problem.

The invention poses and at the same time solves a problem which up to now was entirely unknown in the art, namely:

When an electric resistor is screen-printed on a glass-ceramic material and is thereafter supplied with electric current to provide a heating element by thermal transfer, it appears that, at these high temperatures used in the hot plates, the glass-ceramic material support becomes an electric conductor. It therefore seems that combining a screen-printed high-temperature electric resistor and a glass-ceramic material cannot possibly be applied in a cooking range for general usage, as it would not satisfy the safety standards. It also seems that a screen-printed insulating layer disposed between the glass-ceramic plate and the screen-printed resistor cannot be used as it seems that if one searches for an insulating material having a zero-value coefficient of expansion, one would actually arrive at the formulation of the glass-ceramic material itself which was found to be electrically noninsulating at high temperatures.

However the present invention solves this problem by providing a formulation for an electrically insulating layer at high temperatures and which has a coefficient of expansion which is fully matched adapted to the glass-ceramic support at these high temperatures.

From the prior art it is known that to provide a screen-printing paste a compound of a vitreous phase and a ceramic phase is generally used. During the search for a compound capable of forming the insulating layer, an additional problem was met. To provide a resistor, the material chosen must have a positive or zero temperature coefficient of the resistance for the temperature range considered and this coefficient of resistance must not vary over a period of time during aging of the hot plate. If a material is chosen for the insulating layer which has a significant vitreous phase, or a material whose ceramic phase decomposes at elevated temperatures to become glass, this glass tends to rise up in the resistive layer and, enveloping the conducting particles, to cause the temperature coefficient to decrease, which might even result in this temperature coefficient becoming less than zero. This would lead to a rapid deterioration of the heating element, resulting in breakdown of the resistor. The present invention solves this problem by providing an insulating layer which does not react at elevated temperatures with the resistive layer.

Consequently, the resistor is perfectly insulated at elevated temperatures, its temperature coefficient is positive and the overall device bears the aging process well.

BRIEF DESCRIPTION OF THE DRAWINGS

The invention and how it works will be better understood from the following description given with reference to the accompanying Figures in which:

FIG. 1 is a schematical and cross-sectional view of a heating element;

FIG. 3 is a schematical and sectional view of FIGS. 2*a* and 2*b* taken on the axis I—I;

FIG. 4 is a schematical and sectional view of FIGS. 2*a* and 2*b* taken on the axis II—II;

DETAILED DESCRIPTION OF THE PREFERRED EMBODIMENTS

Figure 2A:
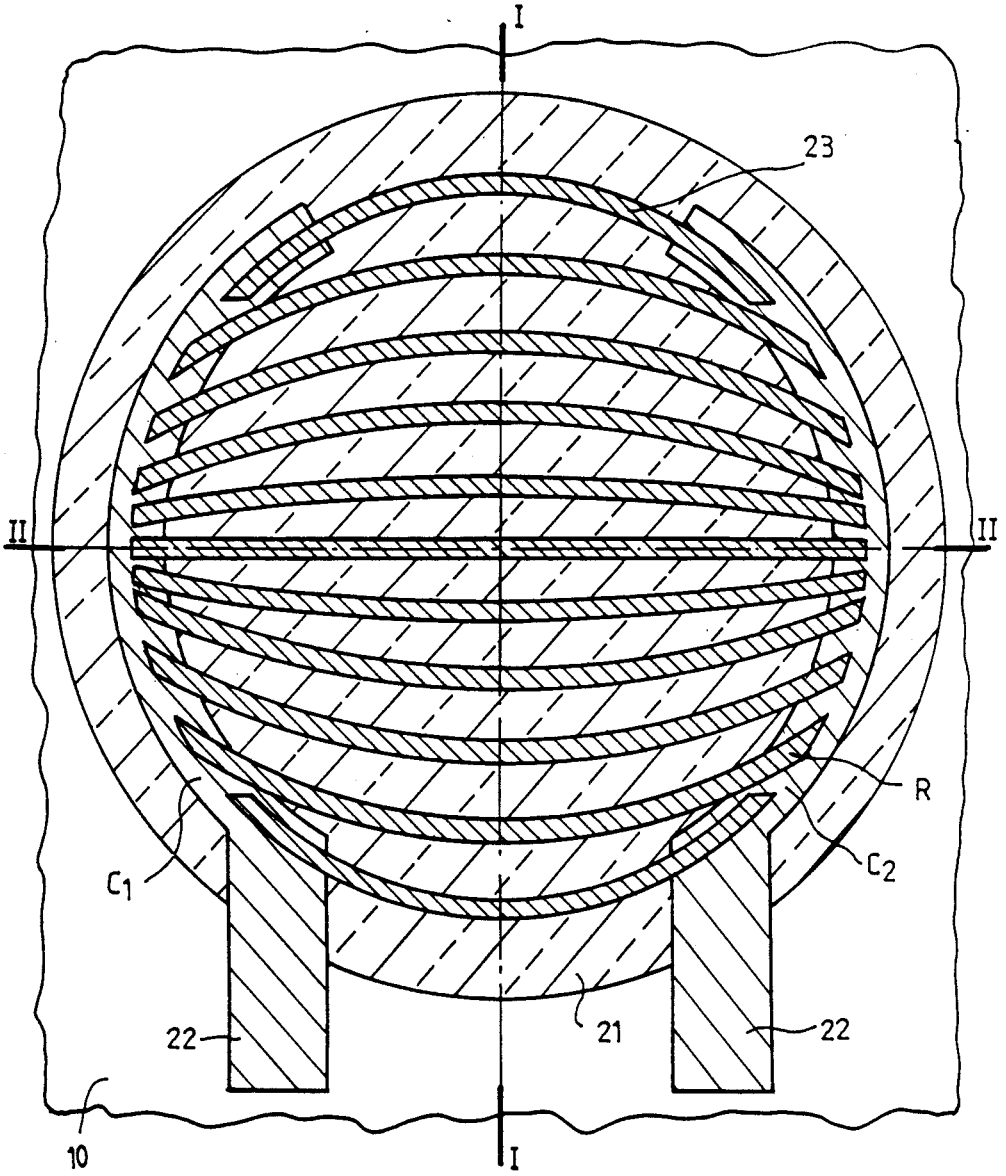
FIGS. 2*a* and 2*b* show the circuit diagrams of two examples of the electric resistor circuit according to the invention, in a plan view.

As is shown in the cross-sectional view in FIG. 1, the glass-ceramic heating element according to the invention comprises a glass-ceramic plate support 10 which serves as a working section on its upper face 11, and a substrate for the heating element 20 on its lower face 12.

Such a heating element has the advantage that it provides a working section which is very smooth and consequently easy to clean, since it has no grooves, in which solid or liquid food particles from the cooking pans could, for example, get lodged. This smooth and flat surface is an advantage as it allows the cooking pans to bear in a very stable manner on the working section, which enables a good thermal exchange.

The lower face 12 of the glass-ceramic plate is covered by at least a heat source constituted by a heating element of the type shown in a plan view in the FIGS. 2.

Up to now, the glass-ceramic material has been chosen for hot plates for aesthetic reasons, the practical qualities described in the foregoing, and above all for the fact that it has a zero coefficient of expansion which renders it very resistant to thermal shocks. On the other hand it has the disadvantage that it is a rather poor heat conductor, so that, when the heating element is at some distance from the surface to be heated a considerable temperature gradient is produced in the air. In this resides an advantage of the present invention which renders it possible to use for the hot plate a heat source which is in direct contact with the glass-ceramic plate, which reduces the thermal resistances.

The poor thermal conductivity of the glass-ceramic material is used as an advantage to maintain between the hot plates, at the exterior of each hot plate, regions which are not hot, where optionally electric contacts can be provided using traditional, consequently cheap, soldering materials.

According to the invention, to prevent the occurrence of electric conduction phenomena which cannot be disregarded at temperatures higher than 300° C. in the glass-ceramic material of the plate, an insulating layer 21 is first directly deposited on the surface 12. This material is of a type which first has a coefficient of expansion which is substantially identical to that of the plate 10 and to the coefficient of expansion of the higher layers 23 and to the coefficient at higher temperatures. This material is also of a type providing an excellent electric insulation at these same high temperatures. Finally this material is of a type which does not diffuse into the resistive layers 23, neither at the cooking temperature nor at elevated temperatures, thus preventing a change in the temperature coefficient (TC) of the resistive layers during aging.

Figure 5A:
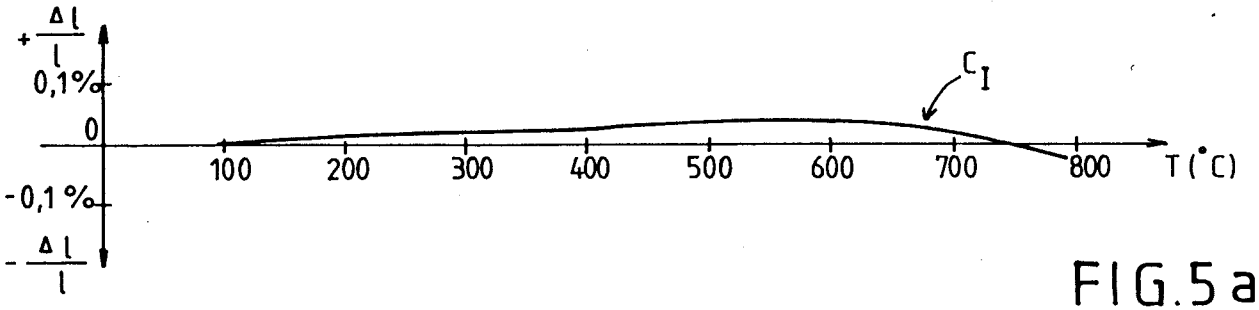
FIG. 5*a* shows the relative linear variations $\Delta l/l$ of the insulating material versus the temperature T.
Figure 5B:
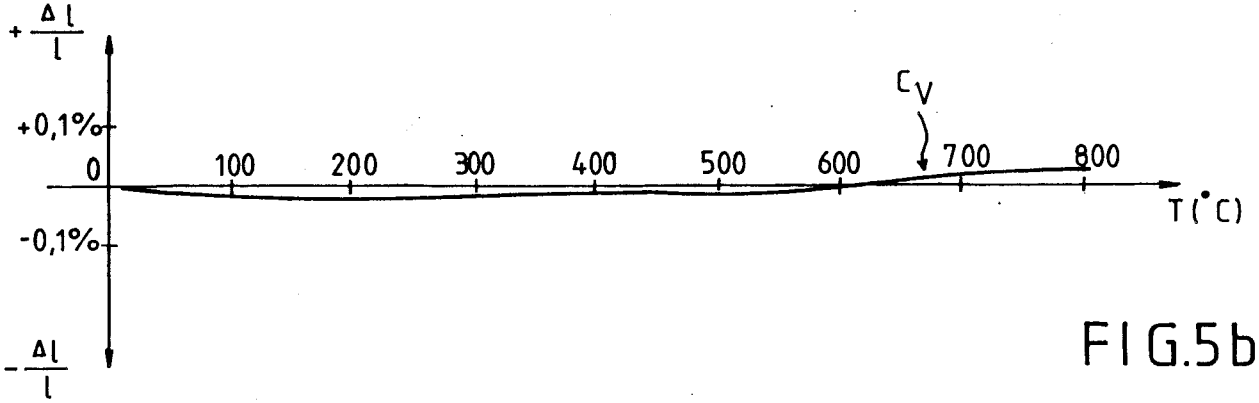
FIG. 5*b* shows the relative linear variations $\Delta l/l$ of the glass-ceramic material versus the time T.

The curve $C_I$ of FIG. 5*a* shows the relative linear variations $\Delta l/l$ of the insulating material 21 as a function of the temperature T, and the curve $C_V$ of FIG. 5*b* shows the corresponding variations of the glass-ceramic material 10 at the same temperatures. These two curves are both very near 0.

Figure 2B:
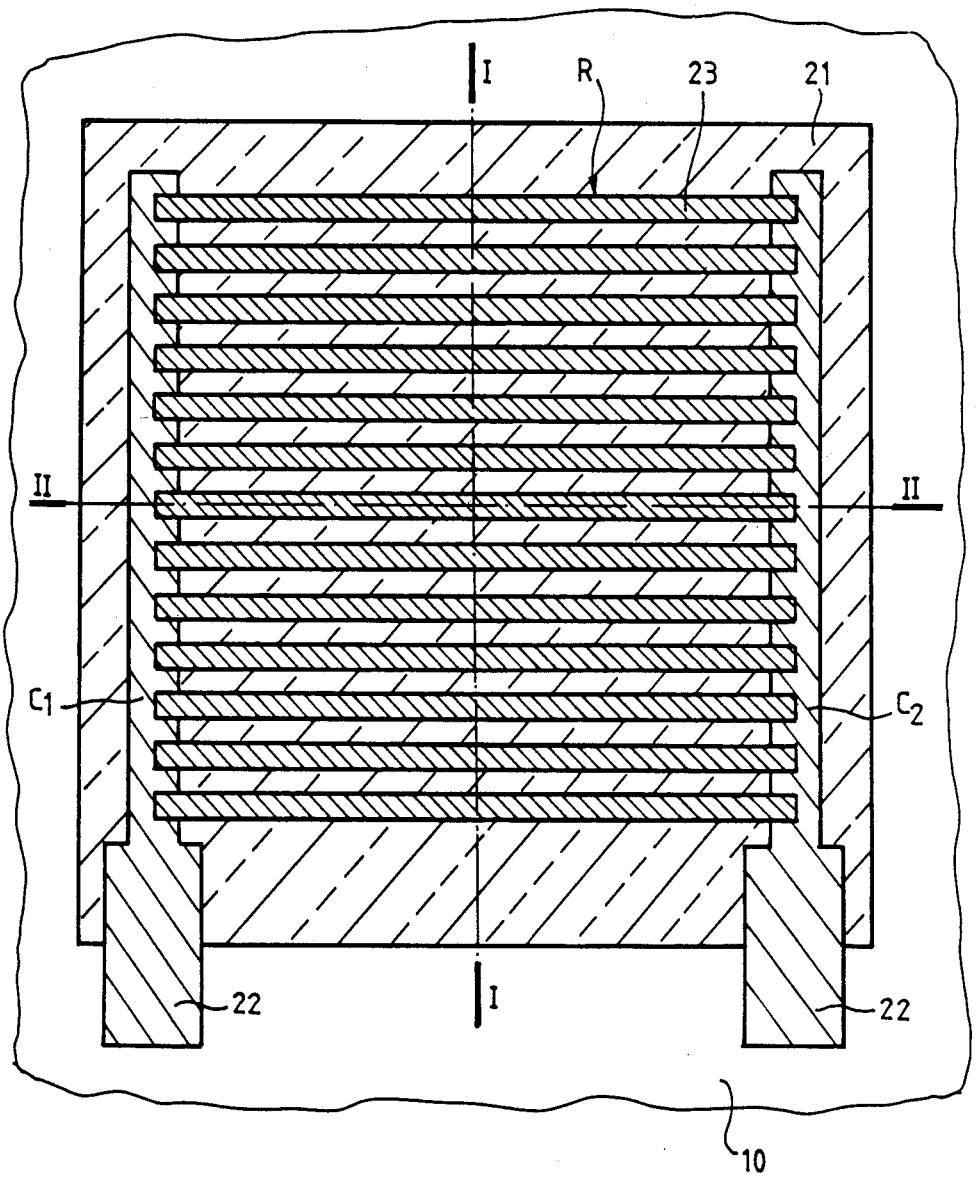

As is shown in the FIGS. 2*a* and 2*b*, the insulating material 21 is deposited on the overall surface of the zone constituting the hot source of the hot plate.

The FIGS. 3 and 4 which are the schematic layers of FIGS. 2*a* and 2*b*, respectively, taken on the axis I—I and II—II show that the insulating layer 21 is a uniform layer of a thickness of 100 μm or more.

Two current supply lines $C_1$ and $C_2$ for electrically supplying the heating element are made in the form of a screen-printed strip deposited in a layer of a thickness of approximately 50 μm, depending on the applied voltage and the desired temperature, on the surface of the insulating layer 21. These lines are made of a conducting compound 22.

Strips R made of a resistive compound 23 deposited as a screen-printed layer of a thickness of approximately 10 to 50 μm extend on the surface of the layer 21 and between the current supply lines 22. The resistive material constituting the layer 23 is present to provide a coefficient of expansion which is as near as possible to the coefficient of expansion of the glass-ceramic material at elevated temperatures.

The FIGS. 2 illustrate two advantageous diagrams of depositing these resistive strips R between the power supply lines. These diagrams are given by way of example only, for the process of realizing the heating element according to the invention can be used indiscriminately and renders it possible to provide absolutely all the types of configuration for this type of circuit.

However, it will be advantageous for an improved operating life of the circuit, to prevent as far as possible the use of a path having acute angles in the production of the resistive strips.

The circuit can thus cover a hot plate, forming a square zone as illustrated by FIG. 2*b*, rectangular, oval or circular as illustrated in FIG. 2*a*. It could moreover be desirable that, in accordance with the wishes of the consumer, or client, to provide a cooking area provided with several hot plates of different shapes. In addition, any desired surface area of the hot plate can be provided, and not only the surfaces of two standard diameters which are at present offered in the trade.

As the circuit according to the invention is provided on the lower face 12 of the glass-ceramic cooking area, the upper face 11 which serves as working area, remains empty.

In a further application of the heating element according to the invention, the circuit can alternatively be provided in a small size on a glass-ceramic support for use as an immersion heater; for example to heat a liquid rapidly to a given temperature. To avoid current losses in the liquid, the circuit can then be covered with an upper insulating layer similar to the layer 21.

For this use in an immersion heater element, the supply terminals are also provided with impervious and insulating sleeves, as in any known type of immersion heaters.

In another application, the heating element according to the invention can also be used to provide a top or bottom heating plate (bottom or ceiling) in a hot air convection oven or a hot air circulation oven, or in a microwave oven.

To properly space the soldered joints of the electric conductors from the heating zone of the hot plate, the lines $C_1$ and $C_2$ are extended to a sufficient extent to ensure that their end is positioned in a relatively cold zone. In view of the rather poor thermal conductivity of the glass-ceramic material, it is sufficient to position the lines $C_1$ and $C_2$ at a distance of some centimeters in a zone in which the temperature will always be sufficiently low to ensure that the glass-ceramic material support will absolutely not act as a current conductor. When the lines $C_1$ and $C_2$ have reached this so-called cold zone, the insulating layer 21 is interrupted under the layer 22 which constitutes these terminals so that this layer 22 comes into direct contact with the glass-ceramic material.

This lay-out is not obligatory, but it is preferred to provide soft solder joints between the end of the lines $C_1$ and $C_2$ and electric conductors intended to conduct the supply current for the heating resistor R. Actually, the layer 22 is secured more firmly, and has a better mechanical resistance, when it is provided directly onto the glass-ceramic material. This renders it then possible to provide joints of the above type.

According to the invention, the layers 21, 22 and 23 are made using a screen-printing technology using compounds whose formulation is given hereinafter.

A starting mixture for an insulating composition from which a high-temperature insulating screen-printing paste, baked in nitrogen, is known from the prior art disclosed in Patent Specification EP-No.0,016,498, which corresponds substantially to U.S. Pat. No. 4,323,652, which describes that the mixture has a vitreous phase constituted by molar ratios of the following oxides:

$SiO_2$: 30 to 55%
ZnO: 20 to 40%
$B_2O_3$: 0 to 20%
$Al_2O_3$: 0 to 10%
SrO, Bal, CaO: 5 to 40%
CoO: 0 to 10% and the ceramic face is constituted by ZnO+CoO, the vitreous phase extending from 85 to 60%, and the ceramic phase extending from 15 to 40% in volume of the mixture.

But this mixture has a coefficient of expansion at elevated temperature which is near that of aluminium, that is to say very far from that of the glass-ceramic material itself.

For that reason, according to the invention, a starting mixture for a screen-printing paste suitable for the layer 21 i.e., being insulating at elevated temperature and having at the same time a coefficient of expansion near that of the glass-ceramic material, and not diffusing into the higher resistive layer, will first of all have a vitreous phase constituted in molar ratios by:

ZnO+MeO: 50 to 65%
$B_2O_3$: 10 to 20%
$Al_2O_3$: 0 to 10%
$SiO_2$: 40 to 50% in which MeO is an oxide chosen from refractory oxide such as MgO, CaO, MeO being associated with ZnO in the molar ratios 0 to 10% of the total of the vitreous phase and such that the ratios ZnO+MeO constitute 50 to 65% in moles of said vitreous phase.

In one embodiment, a vitreous phase will be found which is formed in molar ratios from:

ZnO+MeO: 62%
$B_2O_3$: 17%
$SiO_2$: 21%

In a further embodiment, a vitreous phase will be found which is formed by molar ratios of:

ZnO+MeO: 62%
$B_2O_3$: 12%
$Al_2O_3$: 5%
$SiO_2$: 21%

The starting mixture for such an insulating compound will moreover have an amorphous phase. The vitreous phase and the amorphous phase are related in ratios by volume such as:

vitreous phase 3 to 13%, preferably 5%
amorphous phase 97 to 87%, preferably 95%.

According to the invention, the amorphous phase will be formed by amorphous silicon dioxide which is selected because of its low coefficient of expansion.

Preferably, to provide an insulating screen-printing paste according to the invention, a glass whose molar ratios correspond to the compositions indicated in the foregoing or to one of the cited examples is first processed. The glass thus obtained is milled. During this milling operation the powder forming the amorphous phase in the chosen ratios by volume is mixed-in to obtain a homogeneous mixture.

Milling may be affected in a liquid agent, for example water. The product of the milling operation is thereafter dried and then dispersed in an organic medium.

As an organic medium appropriate to render this starting mixture suitable for screen-printing, a solution containing a polymer can be used, for example a solution of ethyl cellulose in a terpineol or a mixture on the basis of terpineol. This organic medium can represent, before firing, 10 to 40% of the weight of the screen-printing paste. The ratios of the organic medium relative to the paste are chosen as a function of the desired rheologic behavior.

Since in the present case none of the materials chosen for the heating device on glass-ceramic has any risk of oxidizing in air, firing the paste is effected in the open air. The organic medium is thus consumed with the aid of the oxygen in the air. A firing operation at approximately 900° C. is performed in a conveyor oven during approximately 10 minutes.

On the other hand, the Patent Specification EP-0,048,063 which corresponds substantially to U.S. Pat. No. 4,420,338 discloses a starting mixture for a resistive compound having a temperature coefficient of resistance of the order of: $\pm 100\ 10^{-6}$° C.$^{-1}$. This compound comprises an active phase formed by a mixture of bivalent and/or trivalent metallic hexaborite, and a glass frit consisting of calcium borate and, possibly, silicon dioxide.

But in this resistive paste, the glass composition does need not constitute a heating resistor more particularly a heating resistor capable of being raised to 650° C. by means of the Joule effect, and to have a positive temperature coefficient of resistance which is maintained over the years.

Therefore, according to the invention, a starting mixture for a screen-printing paste suitable for use as the layer 23, having this property and a coefficient of expansion near that of the glass-ceramic material will first of all have an active phase constituted in a ratio by volume of the total mixture of:

$RuO_2$: 15 to 40% and, more specifically, preferably $\approx$30.
CuO: 0 to 5% and a vitreous phase having a composition similar to that of molten and hardened glass-ceramic in ratios by volume complementary to the above mixture. Thus, the glass base which acts as a bonding agent, thereafter recrystallizes into glass-ceramic during the same cycle. The glass-ceramic thus formed renders it possible to obtain the appropriate coefficient of expansion.

On the other hand the temperature coefficients of resistance of this resistor, when it is given the preferred ratios, is:

+520 ppm° C.$^{-1}$ between 20° and 30° C. and

+150 ppm° C.$^{-1}$ between 300° and 650° C.

To provide the resistive screen-printing paste, the vitreous phase is milled and the oxides forming the active phase are incorporated in the manner described in the foregoing for the production of the insulating paste. After this procedure the mixture is incorporated in a rheological vehicle already described.

According to the invention, a screen-printing paste suitable to produce the lines $C_1$ and $C_2$ in the layer 22, will be formed in one example of a silver power (Ag) plus palladium (Pd) or platinum (Pt), or in a further example of a silver powder (Ag) only, to which a small portion of copper oxide (CuO) is added, this powder thereafter being incorporated in a rheological vehicle such as the one described above.

The following Tables list the starting mixture compositions for the layers 21, 22 and 23.

TABLE I

| Starting mixture for the insulating layer 2 | | | |
|---|---|---|---|
| Vitreous phase = molar composition in % | | | |
| General composition | | Example A | Example B |
| ZnO + MeO | 50 a 65% | 62% | 62% |
| $SiO_2$ | 40 a 5% | 21% | 21% |
| $B_2O_3$ | 10 a 20% | 17% | 12% |
| $Al_2O_3$ | 0 a 10% | 0% | 5% |
| Starting mixture = composition in volume | | | |
| General composition | | Preferred embodiment | |
| Vitreous phase | 3 to 13% | 5% | |
| Amorphous phase | 97 to 87% | 95% | |

TABLE II

| starting mixture for the resistance layer 23 Composition of the mixture in a percentage by volume | | | |
|---|---|---|---|
| | | Preferred embodiment | General composition |
| Vitreous Phase = | composition similar to glass ceramic | ≃65% | Complement to 100% |
| Active Phase | $RuO_2$ | ≃30% | ≃15 a 40% |
| | CuO | ≃5% | ≃0 a 5% |

TABLE III

| starting mixture for the conducting layer 22 Composition of the mixture in % by volume | |
|---|---|
| Example 1 | Example 2 |
| Ag 80 a 100% | Ag 80 a 100% |
| CuO 20 a 0% | Pd/Pt 20 a 0% |
| | CuO in complementary percentage |

What is claimed is:

1. A glass-ceramic heating element comprising at least a flat electric heating member which is provided on a glass-ceramic plate and can be heated to a temperature between ambient temperature and approximately 650° C. forming a heat source, wherein the electric heating member is produced by depositing screen-printed layers on a lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures, a second layer 22 of a conducting material to form two current supply lines $C_1$ and $C_2$ for the input and the output of the heating member and a third layer 23 of a dielectric material to constitute a heating resistor R arranged between the lines $C_1$ and $C_2$ in the form of a circuit of such a design that it can uniformly distribute the heat over the overall heat source surface and wherein the insulating layer 21 does not react with the resistor layer 23 at elevated temperatures.

2. A glass-ceramic heating element comprising at least a flat electric heating member which is provided on a glass-ceramic plate and can be heated to a temperature between ambient temperature and approximately 650° C. forming a heat source, wherein the electric heating member is produced by depositing screen-printed layers on a lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures, a second layer 22 of a conducting material to form two current supply lines $C_1$ and $C_2$ for the input and the output of the heating member and a third layer 23 of a dielectric material to constitute a heating resistor R arranged between the lines $C_1$ and $C_2$ in the form of a circuit of such a design that it can uniformly distribute the heat over the overall heat source surface, wherein the insulating layer 21 does not react with the resistor layer 23 at elevated temperatures and wherein the layer 21 entirely insulates the surface of the heat source from the base plate; the conductive layer 22 and lines $C_1$ and $C_2$ being provided as two strips which are insulated from each other and disposed on both sides of the heat source at its periphery; and the resistive layer 23 being constituted by several strips extending from the line $C_1$ to the line $C_2$ and spaced apart and distributed to heat the total surface of the source.

3. A heating element as claimed in claim 2, wherein the strips of the conductive layer 22 are linear, the strips of the resistive layer 23 are linear and parallel and in that the heat source is of a square or a rectangular shape.

4. A heating element as claimed in claim 2, wherein the strips of the conductive layer 22 are an arc of circle, in that the strips of the resistive layer 23 are an arc of circle and the heat source has a shape which is near the shape of a circle or the shape of an oval.

5. A starting mixture for an insulating paste suitable for the production of a layer 21 of a heating element comprising at least a flat electric heating member which is provided on a glass-ceramic plate and can be heated to a temperature between ambient temperature and approximately 650° C. forming a heat source, wherein the electric heating member is produced by depositing screen-printed layers on a lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures having a vitreous phase formed by molar ratios of:

$ZnO+MeO$: 50 to 65%
$B_2O_3$: 10 to 20%
$Al_2O_3$: 0 to 10%
$SiO_2$: 40 to 50% wherein MeO is an oxide chosen from refractory oxides associated with ZnO in molar ratios from 0 to 10% of the total vitreous phase such that the ratios $ZnO+MeO$ constitute 50 to 65 mol % of said vitreous phase, said material having an amorphous phase formed by amorphous silicon dioxide and wherein the vitreous phase is associated with the amorphous phase in ratios of 3 to 13 vol. % for the vitreous phase and from 97 to 87% for the amorphous phase.

6. A starting mixture as claimed in claim 5, wherein the vitreous phase is composed in molar ratios of:

$ZnO+MeO$: 62%
$SiO_2$: 21%
$B_2O_3$: 17%.

7. A starting mixture as claimed in claim 5, wherein the vitreous phase is formed in molar ratios of:

$ZnO+MeO$: 62%
$SiO_2$: 21%
$B_2O_3$: 12%
$Al_2O_3$: 5%.

8. A starting mixture as claimed in claims 5, 6 or 7, wherein the vitreous phase is in a ratio of 5% and the amorphous phase is in a ratio of 95% by volume of the total mixture.

9. A starting mixture for a resistive paste suitable to obtain a resistive layer 23 of a heat source comprising at least a flat electric heating member which is provided on a glass-ceramic plate and can be heated to a temperature between ambient temperature and approximately 650° C. forming a heat source, wherein the electric heating member is produced by depositing screen-printed layers on a lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures, a second layer 22 of a conducting material to form two current supply lines $C_1$ and $C_2$ for the input and the output of the heating member and a third layer 23 of the dielectric material to constitute a heating resistor R arranged between the lines $C_1$ and $C_2$ in the form of a circuit of such a design that it can uniformly distribute the heat over the overall heat source surface and wherein the insulating layer 21 does not react with the resistor layer 23 at elevated temperatures and said layer 23 has an active face constituted in ratios by volume of the total mixture of:

$RuO_2$: 15 to 40%
CuO: 0 to 5%.

10. A starting mixture for a conductive paste suitable to obtain a conductive layer 22 of a heat source for a heating element comprising at least a flat electric heating member which is provided on a glass-ceramic plate and can be heated to a temperature between ambient temperature and approximately 650° C. forming a heat source, wherein the electric heating member is produced by depositing screen-printed layers on a lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures, a second layer 22 of a conducting material to form two current supply lines $C_1$ and $C_2$ for the input and the output of the heating member and a third layer 23 of the dielectric material to constitute a heating resistor R, arranged between the lines $C_1$ and $C_2$ in the form of a circuit of such a design that it can uniformly distribute the heat over the overall heat source surface and wherein the insulating layer 21 does not react with the resistor layer 23 at elevated temperatures, said layer 22 being formed from silver powder (Ag) and copper oxide (CuO) in respective ratios by volume from 80 to 100% and from 20 to 0%.

11. A starting mixture for a conductive paste suitable to obtain a conductive layer 22 of a heat source for a heating element comprising at least a flat electric heating member which is provided on a glass-ceramic plate and can be heated to a temperature between ambient temperature and approximately 650° C. forming a heat source, wherein the electric heating member is produced by depositing screen-printed layers on the lower surface of the glass-ceramic plate, these layers having a coefficient of expansion near that of the glass-ceramic material at elevated temperatures and being capable of being heated by thermal dissipation to temperatures of at least 650° C., said heating member being formed starting from this lower surface by a first layer 21 of a material constituting an electric insulator at high temperatures, a second layer 22 of a conducting material to form two current supply lines $C_1$ and $C_2$ for the input and the output of the heating member and a third layer 23 of a dielectric material to constitute a heating resistor R arranged between the lines $C_1$ and $C_2$ in the form of a circuit of such a design that it can uniformly distribute the heat over the overall heat source surface and wherein the insulating layer 21 does not react with the resistor layer 23 at elevated temperatures, said layer 22 being formed from silver powder (Ag) and palladium (Pd) or platinum (Pt) in respective ratios by volume from 80 to 100% and from 20 to 0%.

12. A method of providing a heating element comprising at least a flat electric heating member which is provided on a glass-ceramic plate and can be heated to a temperature between ambient temperature and approximately 650° C. forming a heat source, comprising at least the following steps:

(a) The deposition by means of screen-printing of an insulating layer 21 in accordance with the configuration chosen for this layer by means of a resistive paste formed from a starting mixture as claimed in claim 5, 6, 7 or 8 incorporated into a rheologic medium comprising a mixture of terpineol in a ratio from 10 to 40% of the weight of the screen-printing paste;

(b) Firing this layer in air at a temperature of approximately 900° C. during approximately 10 minutes;

(c) The deposition by means of screen-printing of a conductive layer 22 in accordance with the configuration chosen to form current supply lines $C_1$ and $C_2$, the deposition being produced using a conductive paste formed from a starting mixture as claimed in claim 10 or 11 incorporated in a rheologic medium in a ratio from 10 to 40% of the weight of the screen-printing paste;

(d) Firing this layer in air, at a temperature of approximately 900° C.;

(e) The deposition by means of screen-printing of resistive layer 23 in accordance with the configuration chosen to form a heating resistor R, the deposition being produced using a resistive paste formed from a starting mixture as claimed in claim 9 incorporated in a rheological medium in ratios from 10 to 40% of the total weight of the screen-printing paste; and (f) Firing this layer in air, at a temperature of approximately 900° C.

13. A starting mixture for an insulating paste suitable for the production of the layer 21 of a heating element as claimed in claim 2, having a vitreous phase formed by molar ratios of:

ZnO+MeO: 50 to 65%
$B_2O_3$: 10 to 20%
$Al_2O_3$: 0 to 10%
$SiO_2$: 40 to 50% wherein MeO is an oxide chosen from refractory oxides associated with ZnO in molar ratios from 0 to 10% of the total vitreous phase such that the ratios ZnO+MeO constitute 50 to 65 mol % of said vitreous phase and having an amorphous phase formed by amorphous silicon dioxide, wherein the vitreous phase is associated with the amorphous phase in ratios of 3 to 13 vol. % for the vitreous phase and from 97 to 87% for the amorphous phase.

14. A starting mixture as claimed in claim 13, wherein the vitreous phase is composed in molar ratios of:

ZnO+MeO: 62%
$SiO_2$: 21%
$B_2O_3$: 17%.

15. A starting mixture as claimed in claim 13, wherein the vitreous phase is formed in molar ratios of:

ZnO+MeO: 62%
$SiO_2$: 21%
$B_2O_3$: 12%
$Al_2O_3$: 5%.

16. A starting mixture as claimed in claims 13, 14 or 15, wherein the vitreous phase is in a ratio of 5% and the amorphous phase is in a ratio of 95% by volume of the total mixture.

17. A starting mixture for a resistive paste suitable to obtain the resistive layer 23 of a heat source as claimed in claim 13, wherein it has an active face constituted in ratios by volume of the total mixture of:

$RuO_2$: 15 to 40%
CuO: 0 to 5% and a vitreous phase in complementary ratios by volume formed by a composition similar to that of the glass-ceramic.

18. A starting mixture for a conductive paste suitable to obtain conductive layer 22 of a heat source for a heating element as claimed in claim 13, formed from silver powder (Ag) and copper oxide (CuO) in respective ratios by volume from 80 to 100% and from 20 to 0%.

19. A starting mixture for a conductive paste suitable to obtain the conductive layer 22 of a heat source for a heating element as claimed in claim 13, formed from silver powder (Ag) and palladium (Pd) or platinum (Pt) in respective ratios by volume from 80 to 100% and from 20 to 0%.

20. A method of providing a heating element, comprising at least the following steps:

(a) The deposition by means of screen-printing of an insulating layer 21 in accordance with the configuration chosen for this layer by means of a resistive paste formed from a starting mixture as claimed in claim 13, 14, 15 or 16 incorporated into a rheologic medium comprising a mixture of terpineol in a ratio from 10 to 40% of the weight of the screen-printing paste;

(b) Firing this layer in air at a temperature of approximately 900° C. during approximately 10 minutes;

(c) The deposition by means of screen-printing of a conductive layer 22 in accordance with the configuration chosen to form current supply lines $C_1$ and $C_2$, the deposition being realized using a conductive paste formed from a starting mixture as claimed in claim 18 or 19 incorporated in a rheologic medium comprising a mixture of terpineol in a ratio from 10 to 40% of the weight of the screen-printing paste;

(d) Firing this layer in air at a temperature of approximately 900° C. during approximately 10 minutes;

(e) The deposition by means of screen-printing of a resistive layer 23 in accordance with the configuration chosen to form a heating resistor R, the deposition being obtained using a resistive paste formed from a starting mixture as claimed in claim 17 incorporated in a rheological medium comprising as a mixture of terpineol in ratios from 10 to 40% of the total weight of the screen-printing paste; and (f) Firing this layer in air at a temperature of approximately 900° C. during approximately 10 minutes.

* * * * *